US007047569B1

(12) United States Patent
Mahon et al.

(10) Patent No.: US 7,047,569 B1
(45) Date of Patent: May 23, 2006

(54) CHILD'S CAPE COAT

(76) Inventors: Joi Mahon, 4614 Polk St., Sioux City, IA (US) 51108; LeeAnn M. Fowler, E1000 3A Trout Rd., Wisconsin Dells, WI (US) 53965

( * ) Notice: Subject to any disclaimer, the term of this patent is extended or adjusted under 35 U.S.C. 154(b) by 55 days.

(21) Appl. No.: 10/806,887

(22) Filed: Mar. 23, 2004

Related U.S. Application Data

(60) Provisional application No. 60/456,862, filed on Mar. 24, 2003.

(51) Int. Cl.
*A41D 3/08* (2006.01)

(52) U.S. Cl. ..... 2/88; 2/111

(58) Field of Classification Search ..... 2/69, 2/75, 80, 69.5, 84–90, 92–96, 108, 111, 113, 2/114

See application file for complete search history.

(56) References Cited

U.S. PATENT DOCUMENTS

| | | | | | |
|---|---|---|---|---|---|
| 1,309,487 | A | * | 7/1919 | Resser | 2/75 |
| 1,403,030 | A | * | 1/1922 | Janzow | 2/75 |
| 1,797,604 | A | * | 3/1931 | Burgdorfer | 2/75 |
| 1,891,692 | A | * | 12/1932 | Senzer | 2/93 |
| 2,072,644 | A | * | 3/1937 | McBee | 2/84 |
| 2,144,875 | A | * | 1/1939 | Forrest | 2/88 |
| 2,179,548 | A | * | 11/1939 | Ford | 2/94 |
| 2,340,017 | A | * | 1/1944 | Rasmussen | 2/270 |
| 2,442,749 | A | * | 6/1948 | Callahan et al. | 2/87 |
| 2,464,946 | A | * | 3/1949 | Ryan | 2/75 |
| 2,649,589 | A | * | 8/1953 | Shiltong | 2/75 |
| 2,714,718 | A | * | 8/1955 | Kramer | 2/70 |
| 2,775,771 | A | * | 1/1957 | Heilbronner | 2/270 |
| 3,187,344 | A | * | 6/1965 | Porcello | 2/93 |
| 3,258,781 | A | * | 7/1966 | Klein | 2/88 |
| 3,435,461 | A | | 4/1969 | Artzt | 2/83 |
| 3,568,213 | A | | 3/1971 | Mason | 2/80 |
| 3,965,487 | A | | 6/1976 | Mazur | 2/69.5 |
| 4,227,264 | A | * | 10/1980 | Spector et al. | 2/84 |
| 4,257,127 | A | | 3/1981 | Kaupin et al. | 2/75 |
| 4,297,746 | A | * | 11/1981 | Zarbos | 2/108 |
| 4,304,007 | A | | 12/1981 | Ito | 2/74 |
| 4,382,303 | A | * | 5/1983 | Lunt | 2/114 |
| 4,649,573 | A | * | 3/1987 | Yen | 2/74 |
| 4,726,076 | A | | 2/1988 | Douez | 2/69 |
| 4,756,027 | A | * | 7/1988 | Buenos et al. | 2/123 |
| 5,125,117 | A | * | 6/1992 | Buenos et al. | 2/239 |

(Continued)

FOREIGN PATENT DOCUMENTS

GB 2253776 A * 9/1992

*Primary Examiner*—Alissa L. Hoey
(74) *Attorney, Agent, or Firm*—Thomte, Mazour & Niebergall; Shane M. S. Niebergall

(57) ABSTRACT

A garment for children is provided having a body portion formed from a single piece of material in a simple geometric design. A generally curved body portion uses as few as four slits to form a front portion, back portion and opposing arm portions. A front slit can be provided to split the front portion. A neck opening is centrally located and permits the garment to fold around and be secured to the child while the child lays on the same. Optional mitten and hood members can be integrally or removably formed with the garment.

19 Claims, 3 Drawing Sheets

U.S. PATENT DOCUMENTS 5,131,096 A * 7/1992 Olson ..... 2/75
5,367,709 A 11/1994 Teasley ..... 2/69
5,553,323 A * 9/1996 Chou et al. ..... 2/114
5,815,833 A * 10/1998 Kuo ..... 2/69.5
5,875,492 A * 3/1999 Moss ..... 2/93
5,950,240 A * 9/1999 Carpenter et al. ..... 2/160
6,253,381 B1 * 7/2001 Kelley ..... 2/125
6,327,711 B1 * 12/2001 Fujiwara ..... 2/69
6,360,370 B1 * 3/2002 Ferreras ..... 2/84
6,421,834 B1 * 7/2002 Kester ..... 2/94
6,839,911 B1 * 1/2005 Mathews ..... 2/93
2003/0177563 A1 * 9/2003 Reich ..... 2/75

* cited by examiner

CHILD'S CAPE COAT

CROSS-REFERENCE TO RELATED APPLICATION

This application claims the benefit of U.S. Provisional Application Ser. No. 60/456,862 entitled A CHILD'S CAPE COAT filed Mar. 24, 2003, the disclosure of which is hereby incorporated herein by reference.

BACKGROUND OF THE INVENTION

1. Field of the Invention

The present invention relates generally to clothing for children and, more particularly, to a coat for a child that is quickly and easily assembled around the child rather than sliding the child's head or arms through narrow apertures in the coat.

2. Description of the Related Art

Children and infants can be difficult to clothe at times. Narrow openings, such as those frequently found within sleeves and neck holes of garments become difficult targets while the child flails its arms and wiggles about. Moreover, the child has to be rolled from side to side or partially, if not totally, elevated from the table or floor in order to properly clothe the child in the garment. More times than not, the child is difficult to maneuver leading to further difficulty and frustration.

Various prior art garments have been designed in an effort to simplify the process of clothing a child or infant. In U.S. Pat. No. 3,568,213 Mason discloses a garment for an infant that incorporates a pair of upper and lower garments into a single article of clothing that can be placed on the infant simultaneously. However, the general design of Mason's garment pattern is fairly complex in its geometry, when manufacturing considerations, such as sizing, are considered. This leads to increases in manufacturing costs and decreases the garment's ease of use by the consumer. Moreover, Mason's design fails to provide for adequate limb coverage, thus decreasing its available uses.

In U.S. Pat. No. 4,257,127, Kaupin, et al., discloses an infant garment that also incorporates upper and lower garments to increase the speed and ease of clothing the child. The Kaupin, et al design improves upon the Mason design to the extent that the Kaupin, et al. design provides better limb coverage for the child. However, the Kaupin, et al. design is more complex than the Mason design and is more difficult to assemble, thus departing the goals of simplicity and ease of use. Such is the case for a similar design of children's garment, disclosed in U.S. Pat. No. 4,726,076, by Douez.

Few children's clothing designs can be found within the prior art that are both simple in geometry and easy to use when clothing a child. One example of a prior art children's jacket is U.S. Pat. No. 4,304,007, by Ito. The Ito garment is fabricated using a body blank and two separate gusset blanks. The gusset blanks are specifically kite-shaped and are coupled to the geometric design of the body blank to form the jacket. Due to its geometric design that requires the use of separate component panels, Ito fails to achieve a garment that is easy to use while remaining simple in design.

Accordingly, what is needed is a child's garment that is simple in design and increases the ease with which a child can be clothed.

SUMMARY OF THE INVENTION

The child's garment of the present invention is provided with a generally circular body blank, having a neck opening, a front portion, a rear portion and opposite sleeve portions. Two pairs of side slits extend radially, inward from the peripheral edge of the body blank, toward the neck opening. Each slit defines a lateral edge of both a sleeve and either the front or rear portion of the body blank. A single elongated slit is formed in the front portion of the body blank to form separate right and left halves of the front portion. Securement means are provided adjacent each of the slits to selectively secure the lateral edge portions to one another for selective formation of the sleeves and body of the garment.

Optional mittens are provided in the form of two pocket-shaped members, which are each formed to have a single hand compartment, without separate compartments for thumbs or fingers, using a single piece of material. The mittens may be secured to the underside of each opposing sleeve blank and receive the child's hands when the garment is in use. Similarly, a hood may be provided in a simple geometric shape that permits removable engagement with the neck opening in the body of the garment.

In use, the garment is quickly and easily assembled around the child using a brief series of folding maneuvers. The sleeves and body of the garment are assembled while the child lies on the inner surface of the rear panel. Accordingly, the simple design allows the garment to be placed on the child without struggling to find the sleeves and mittens with the child's arms and hands or forcing the child's head through a narrow neck opening.

It is therefore one of the principle objects of the present invention to provide a child's garment that is easy assembled around the child with minimal manipulation of the child or its appendages.

A further object of the present invention is to provide a child's garment that is comprised of a single, seamless panel of material.

Still another object of the present invention is to provide a child's garment that is versatile and simple to use.

Yet another object of the present invention is to provide a child's garment that can be used to clothe a child quickly and easily, even while the child is moving its arms and legs about.

Still another object of the present invention is to provide a cape coat, having a simple geometric design that is simple and relatively inexpensive to manufacture.

Yet another object of the present invention is to provide a child's garment that has integral mitten and hood portions, which can be selectively used or removed from the garment.

These and other objects of the present invention will be apparent to those of skill in the art.

DESCRIPTION OF THE PREFERRED EMBODIMENT

Figure 1:
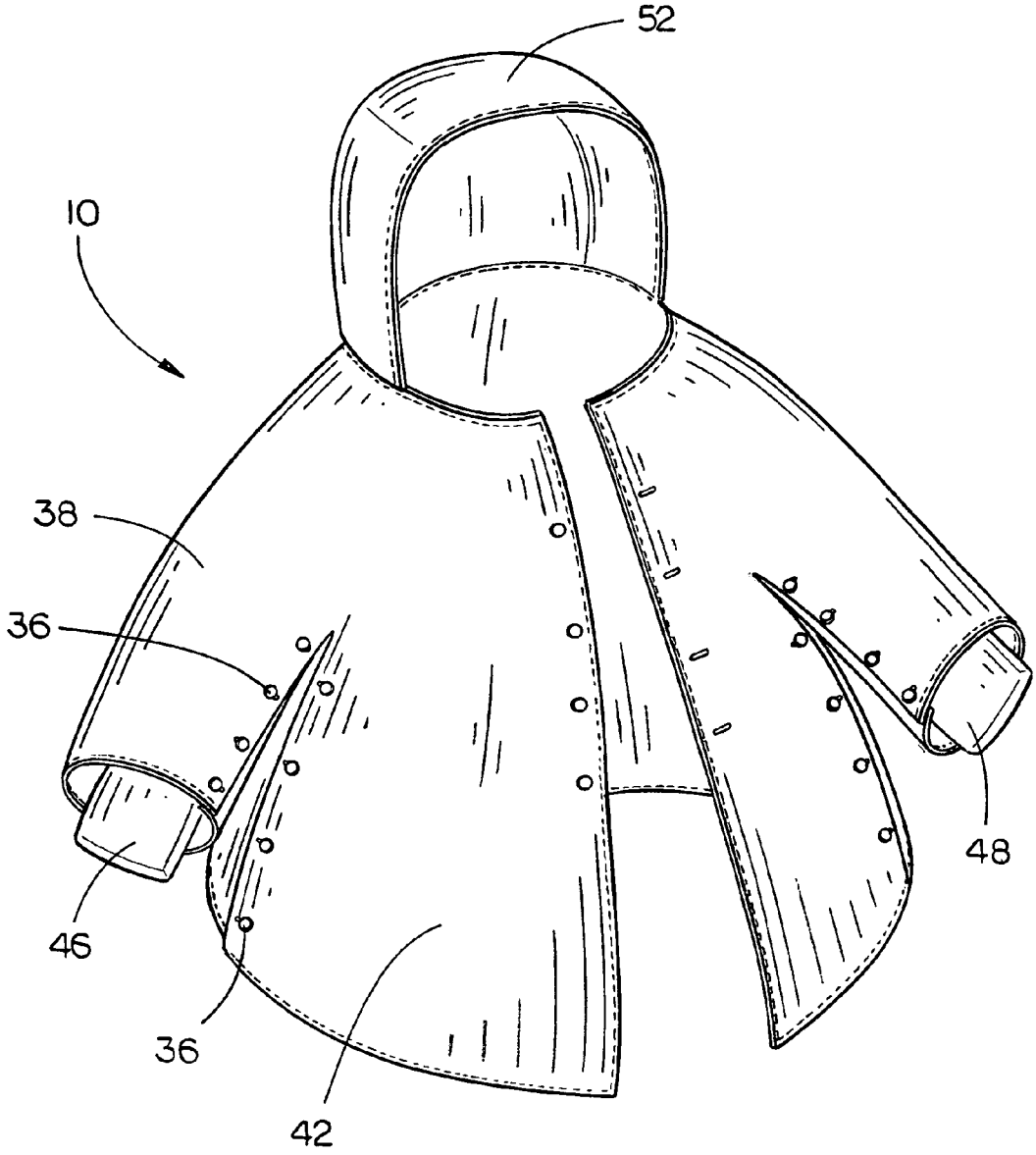
FIG. 1 is an isometric view of one embodiment of the garment of the present invention as the same could be assembled and combined with optional mitten and hood portions.
Figure 2:
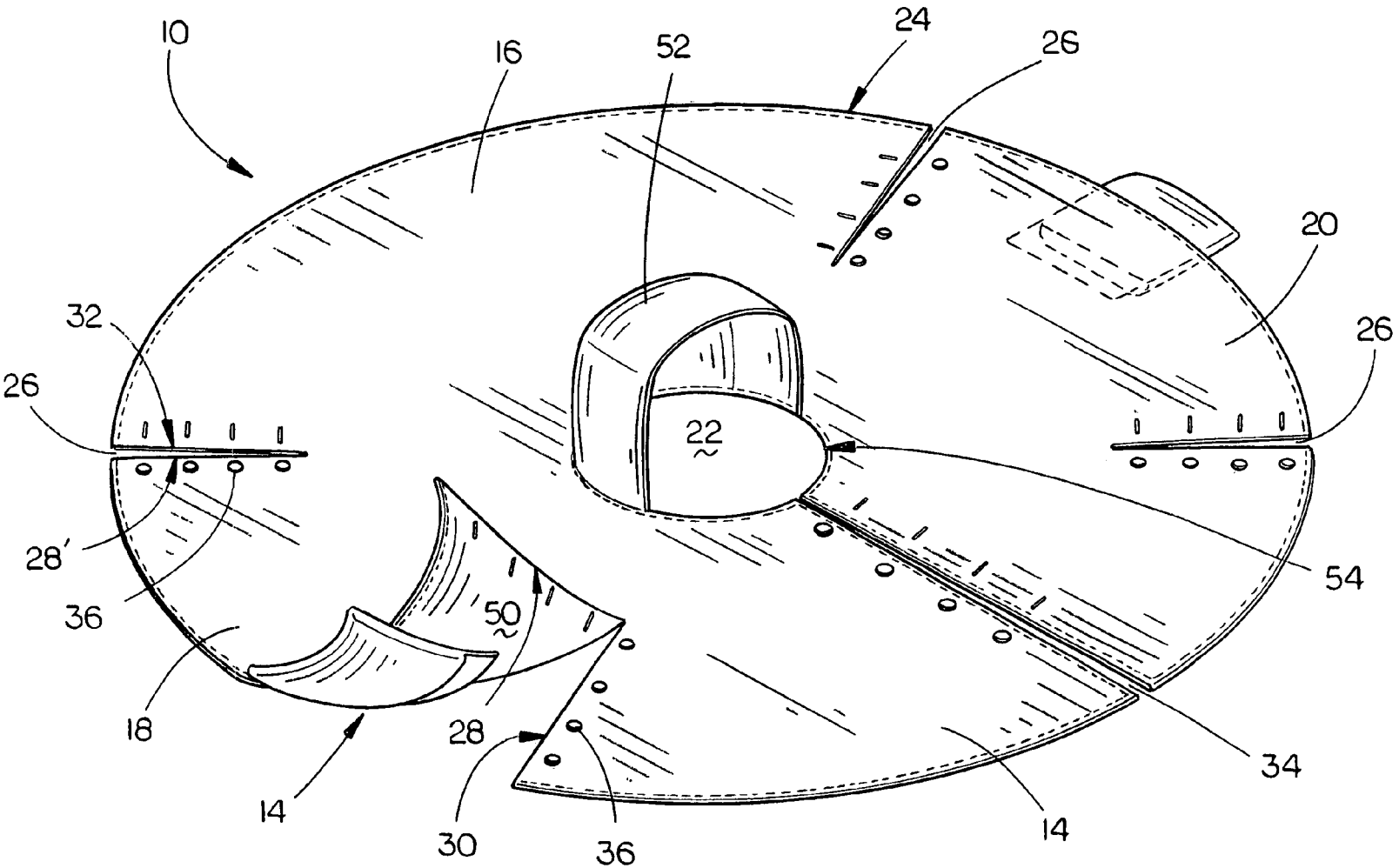
FIG. 2 is an isometric view of the garment of FIG. 1 in a generally disassembled form.

The garment 10 of the present invention is generally depicted in FIGS. 1 and 2. While the garment 10 will be described and depicted herein as a child's garment, it will be clear to those of skill in the art that the garment could be made for individuals of any age, ranging from infancy to adulthood. Moreover, while the garment 10 is described as a cape coat, it should also be understood that the term "cape coat" is used by way of example and not by limitation as various articles of clothing and outerwear may be interchangeable with one another while being known by one or more different names.

The garment 10 is generally provided with a body blank 12 formed from nearly any flexible material that is preferred, depending on the intended use. The body blank 12 is formed to have a front panel 14, a rear panel 16, a first sleeve blank 18 and a second opposing sleeve blank 20. A neck opening 22 is centrally formed within the body blank 12. A peripheral edge portion 24 generally defines the shape of the body blank 12. It is preferred that the peripheral edge portion 24 have a generally curved shape. While it is contemplated that circular, elliptical, ovular, and other such curved shapes would suffice in the design of the garment 10, it is also contemplated that shapes having a plurality of flattened sides, such as hexagons, octagons, and the like will fit within the realm of useable "curved" shapes.

A series of four side slits 26 are formed into the body blank 12 and extend inwardly from the peripheral edge portion 24 toward the neck opening 22. The side slits 26 are preferably disposed with respect to one another so that each slit defines at least one lateral edge 28 of either the first sleeve blank 18 or second sleeve blank 20 and a lateral edge 30 of the front panel 14 or a lateral edge portion 32 of the rear panel 16. A front slit 34 is preferably formed in the front panel 14 to extend outwardly from the neck opening 22. It is preferred that the front slit 34 extend through the peripheral edge portion 24 in order to separate the front panel 14 into opposing right and left portions. However, it is contemplated that the front slit 34 may extend only partially toward the peripheral edge portion 24, when an open-front garment 10 is not desirable.

The side slits 26 and the front slit 34 are preferably provided with securement means 36 so that the opposing lateral edges 28 of the first and second sleeve blanks 18 and 20 can be selectively coupled to one another to form a first sleeve 38 and second sleeve 40 of the garment 10. Similarly, securement means 36 will be provided adjacent the lateral edge portions of the front panel 14 and rear panel 16 so that they may be selectively coupled to one another to form the body 42 of the garment 10. It is contemplated that nearly any known securement systems in the art could be used for the securement means 36, such as buttons, snaps, zippers, hook and eye combinations or hook and loop material such as Velcro.

Where desirable, optional mitten means 44 may be coupled first and second sleeve blanks 18 and 20 to receive the child's hands when the garment 10 is being worn. As depicted in FIG. 2, first and second mittens 46 and 48 can be coupled to the under side 50 of the body blank 12, proximate the first and second sleeve blanks 18 and 20. It is contemplated that the first and second mittens 46 and 48 could be permanently secured to the garment 10 using stitching, adhesives, and the like. However, the first and second mittens 46 and 48 can optionally be provided in a removable fashion using a securement means similar to those identified previously as securement means 36.

An optional hood 52 could be provided for selectively covering the child's head when the garment 10 is used. The hood 52 is preferably coupled with the inner edge portion 54 of the neck opening 22. Depending on the intended use of the garment 10, the hood 52 could be permanently secured to the inner edge portion 54 or removably secured using a securement means similar to those identified previously as securement means 36.

In use, the garment 10 is easily applied around a child without excessive manipulation of the child or its appendages with respect to the changing surface or the garment 10. Preferably, the garment 10 is first arranged flat on top of a changing surface with each of the securement means 36 being unsecured. The child is then placed on the undersurface 50 of the garment 10 with its head adjacent the neck opening 22. The front panel 14 is folded onto the front of the child, causing the child's head to be gently and easily pass through the neck opening 22. The securement means 36 at the lateral edges 30 and 32 of the front panel 14 and rear panel 16 are then coupled to one another, thus forming the body 42 of the garment 10 around the child. The first and second sleeves 46 and 48 are formed in a similar manner by coupling the securement means 36 at the lateral edges 28 and 28' of the first and second sleeve blanks 18 and 20 around the child's arms. In this manner, the garment 10 is quickly and easily secured around the child with minimal effort or frustration.

Figure 3:
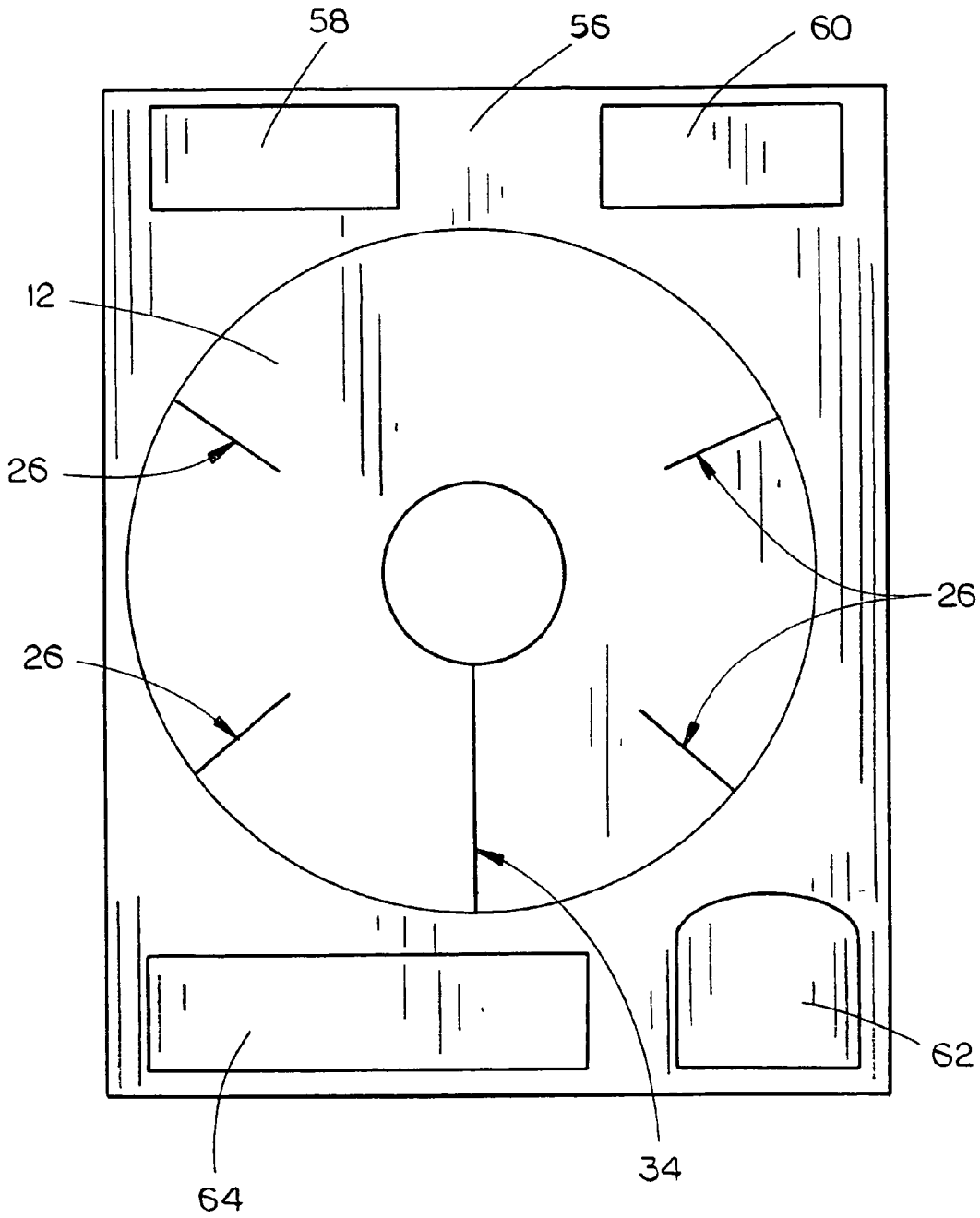
FIG. 3 is a plan view of one embodiment of a pattern from which components of the garment depicted in FIGS. 1 and 2 could be derived.

FIG. 3 depicts a pattern from which components of the garment 10 could be derived, using a single panel of fabric 56. The generally circular body blank 12 is depicted as previously described. First and second mitten blanks 58 and 60 are provided as single elongated pieces of material, which can be easily folded upon themselves and secured to form the first and second mittens 46 and 48. A rear panel 62 and top panel 64 are depicted as one possible embodiment of the design for the hood 52, depicted in FIG. 2.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

What is claimed is:

1. A garment for children, comprising:

a body blank having a neck opening, a front portion, a rear portion, and first and second sleeve blanks;

said body having a peripheral edge portion and at least four side slits extending toward said neck opening from said peripheral edge portion;

said side slits being positioned with respect to one another to define a pair of lateral edge portions for each of said first and second sleeve blanks and a pair of lateral edge portions for each of said front and rear portion;

first securement means for selectively coupling the pairs of lateral edge portions of said first and second sleeve blanks to form first and second sleeves having open interior portions and open distal ends;

second securement means for selectively coupling the pairs of lateral edge portions of said front and rear portions to form a body portion of the garment; and first and second mittens, having peripheral edges that define open ends of said first and second mittens and a single hand compartment, without separate compartments for thumbs or fingers; at least a portion of said peripheral edges being coupled to the interior portions of said first and second sleeves for selectively receiving and at least partially covering a child's hands without the necessity of uncoupling said mitten means from within the interior portions of said first and second sleeves or passing the child's hands completely through the open distal ends of said first and second sleeves.

2. The garment of claim 1 further comprising a front slit that extends from said neck opening toward said peripheral edge portion in said front portion.

3. The garment of claim 2 further comprising a third securement means for selectively securing said front slit in a closed position.

4. The garment of claim 3 wherein said front slit extends from said neck opening to said peripheral edge portion to form selectively separable right and left sides of said front portion.

5. The garment of claim 1 wherein each of said side slits forms a lateral edge portion of one of said first and second sleeve blanks and a lateral edge portion of one of said front and rear portions of said body panel.

6. The garment of claim 1 wherein said peripheral edge portion of said body panel is generally curved.

7. The garment of claim 6 wherein said curved peripheral edge portion defines a generally circular shape for said body blank.

8. The garment of claim 7 wherein each of said side slits forms a lateral edge portion of one of said firsthand second sleeve blanks and a lateral edge portion of one of said front and rear portions of said body panel.

9. The garment of claim 8 further comprising a front slit that extends from said neck opening toward said peripheral edge portion in said front portion.

10. The garment of claim 9 further comprising a third securement means for selectively securing said front slit in a closed position.

11. The garment of claim 10 wherein said front slit extends from said neck opening to said peripheral edge portion to form selectively separable right and left sides of said front portion.

12. The garment of claim 1 wherein said body is formed from a single panel of flexible material.

13. The garment of claim 1 wherein said first and second mittens are each formed from a single panel of flexible fabric.

14. The garment of claim 1 further comprising hood means operatively coupled to an edge portion of said neck opening for selective coverage of a child's head when the child wears the garment.

15. The garment of claim 14 wherein said hood means is selectively removable from said neck opening.

16. The garment of claim 15 further comprising mitten means coupled to said first and second sleeve for selectively covering a child's hands when it wears the garment.

17. The garment of claim 16 wherein said body is formed from a single panel of flexible material.

18. The garment of claim 17 wherein each of said side slits forms a lateral edge portion of one of said first hand second sleeve and a lateral edge portion of one of said front and rear portions of said body panel.

19. The garment of claim 18 wherein said curved peripheral edge portion defines a generally circular shaped for said body.

* * * * *

UNITED STATES PATENT AND TRADEMARK OFFICE

CERTIFICATE OF CORRECTION

PATENT NO. : 7,047,569 B2
APPLICATION NO. : 10/806887
DATED : July 11, 2006
INVENTOR(S) : Sam Lee Woo et al.

It is certified that error appears in the above-identified patent and that said Letters Patent is hereby corrected as shown below:

Claim 18, Column 70, line 30, please replace "phosphothioester" with --phosphotriester--.

Signed and Sealed this

Twenty-eighth Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 7,047,569 B2
APPLICATION NO. : 10/806887
DATED : July 11, 2006
INVENTOR(S) : Joi Mahon et al.

It is certified that error appears in the above-identified patent and that said Letters Patent is hereby corrected as shown below:

This certificate supersedes the Certificate of Correction issued October 28, 2008. The certificate should be vacated since no Certificate of Correction was granted for this patent number.

Signed and Sealed this

Second Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,047,569 B1
APPLICATION NO. : 10/806887
DATED : May 23, 2006
INVENTOR(S) : Joi Mahon et al.

It is certified that error appears in the above-identified patent and that said Letters Patent is hereby corrected as shown below:

This certificate supersedes the Certificate of Correction issued October 28, 2008. The certificate should be vacated since no Certificate of Correction was granted for this patent number.

This certificate supersedes the Certificate of Correction issued December 2, 2008.

Signed and Sealed this

Thirtieth Day of December, 2008

JON W. DUDAS
*Director of the United States Patent and Trademark Office*